US005372927A

United States Patent [19]

Delton

[11] Patent Number: 5,372,927

[45] Date of Patent: Dec. 13, 1994

[54] PROCESS FOR THE LOW PAG PREPARATION OF HIGH ASPECT RATIO TABULAR GRAIN EMULSIONS WITH REDUCED GRAIN THICKNESSES

[75] Inventor: Mary H. Delton, Honeoye Falls, N.Y.

[73] Assignee: Eastman Kodak Company, Rochester, N.Y.

[21] Appl. No.: 139,971

[22] Filed: Oct. 21, 1993

[51] Int. Cl.[5] ..... G03C 1/015

[52] U.S. Cl. ..... 430/569; 430/567

[58] Field of Search ..... 430/569, 567

[56] References Cited

U.S. PATENT DOCUMENTS 4,433,048 2/1984 Solberg et al. ..... 430/434
4,434,226 2/1984 Wilgus et al. ..... 430/567
4,439,520 3/1984 Kofron et al. ..... 430/434
5,061,609 10/1991 Piggin et al. ..... 430/569
5,061,616 10/1991 Piggin et al. ..... 430/569
5,252,453 10/1993 Tsaur et al. ..... 430/569

*Primary Examiner*—Janet C. Baxter
*Attorney, Agent, or Firm*—Carl O. Thomas

[57] ABSTRACT

A process is disclosed of preparing a high bromide high aspect ratio tabular grain emulsion. At least a portion of grain growth is conducted in a temperature range of from 30° to 90° C. within a low pAg window and, during the low pAg grain growth, precipitation is conducted in the presence of chloride ion, which acts to offsets tabular grain thickening attributable to grain growth in the low pAg window.

16 Claims, 1 Drawing Sheet

PROCESS FOR THE LOW PAG PREPARATION OF HIGH ASPECT RATIO TABULAR GRAIN EMULSIONS WITH REDUCED GRAIN THICKNESSES

FIELD OF THE INVENTION

The invention is directed to a process of preparing a tabular grain photographic emulsion.

BACKGROUND

Figure 1:
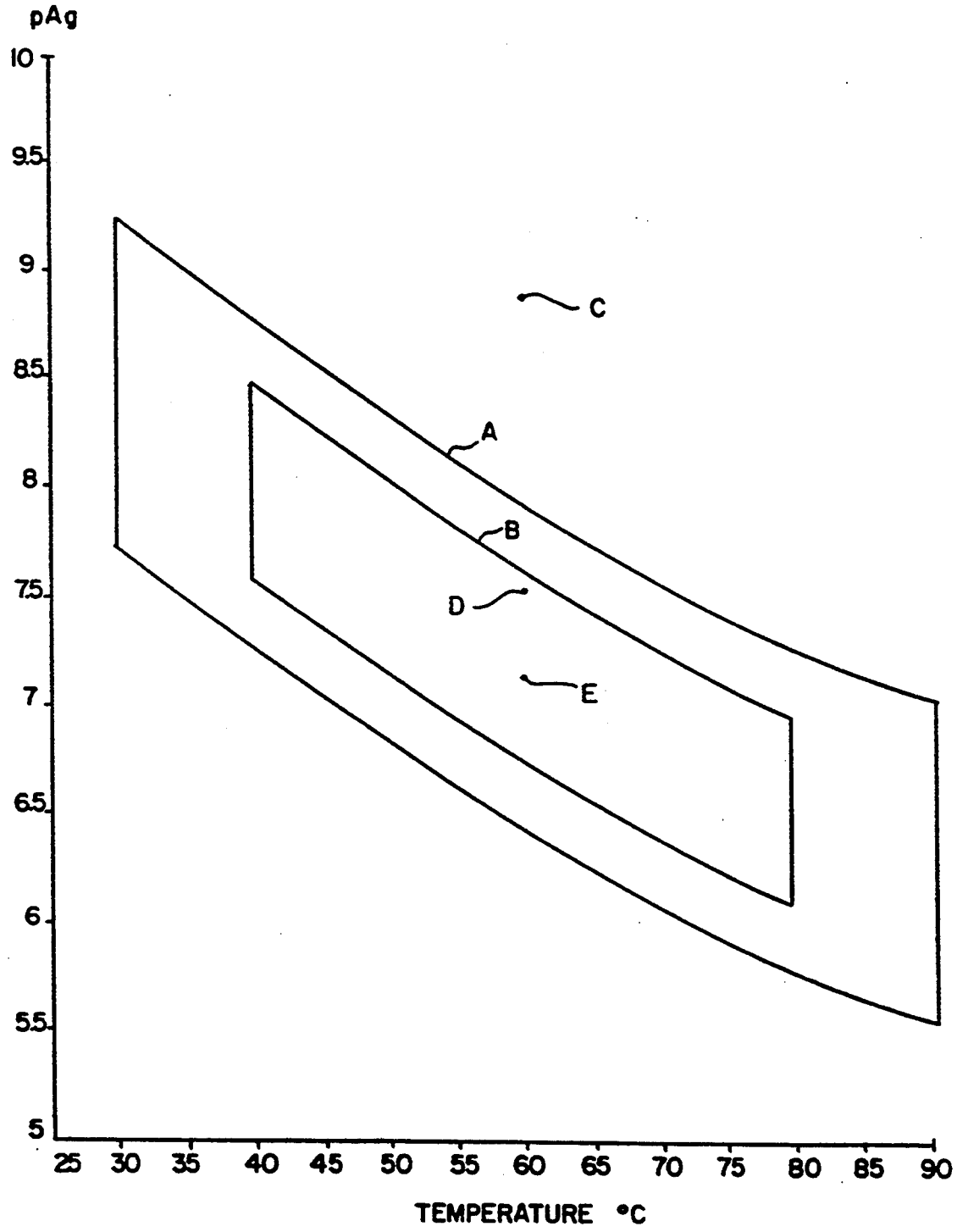
FIG. 1 is a plot of pAg versus temperature in degrees Celsius, Curves A and B also appear in Piggin et al U.S. Pat. Nos. 5,061,609 and 5,061,616.

A variety of photographic advantages have been recognized to be realizable employing high aspect ratio tabular grain emulsions. These advantages include, but are not limited to, improved speed-granularity relationships, increased image sharpness, a capability for more rapid processing, increased covering power, reduced covering power loss at higher levels of forehardending, higher gamma for a given level of grain size dispersity, less image variance as a function of processing time and/or temperature variances, higher separations of blue and minus blue speeds, the capability of optimizing light transmission or reflection as a function of grain thickness and reduced susceptibility to background radiation damage in very high speed emulsions.

Tabular grain emulsions are generally regarded as those emulsions in which tabular grains account for greater than 50 percent of total grain projected area. Tabular grains are those that contain two parallel major faces that are clearly larger than any remaining single grain face. High aspect ratio tabular grain emulsions are those in which tabular grains accounting for greater than 50 percent of total grain projected area exhibit an average aspect ratio of greater than 8. Aspect ratio is defined by the relationship:

$$ECD/t \quad (I)$$

where

ECD is the equivalent circular diameter of a tabular grain and t is the thickness of the tabular grain, both ECD and t being expressed in the same units.

Average aspect ratio can be taken as either the average of the individual tabular grain aspect ratios or the quotient of average tabular grain ECD and average tabular grain thickness.

The overwhelming majority of photographic applications currently employing high aspect ratio tabular grain emulsions are served by those emulsions in which the tabular grains contain at least 50 mole percent bromide, based on total silver. Iodide in varying amounts occasionally ranging up the saturation level of iodide in the silver bromide crystal lattice (approximately 40 mole percent) are often incorporated into the tabular grains to enhance photographic sensitivity. Wilgus et al U.S. Pat. No. 4,434,226, Solberg et al U.S. Pat. No. 4,433,048 and Kofron et al U.S. Pat. No. 4,439,520 disclose representative high aspect ratio tabular grain silver bromide and iodobromide emulsions. (In mixed halide grains the halides are named in order of ascending concentrations.)

Referring to relationship (I) above it is apparent that to maintain high aspect ratios it is essential that tabular grain thickness (t) be maintained small in relation to ECD. Further, there are advantages to be gained photographically by minimizing the thickness of the tabular grains which are independent of average aspect ratio. Each of Wilgus et al, Solberg et al and Kofron et al point out that tabular grain thickening can be expected if tabular grain growth is allowed to occur at a pBr of greater than 2.2, and it is therefore suggested to limit pBr during growth to less than 2.2. pBr is a term analogous to pH. It is the negative log of the bromide ion activity of the dispersing medium within a reaction vessel during silver halide grain precipitation.

While high aspect ratio tabular grain silver bromide and iodobromide emulsions have advanced the state of the art in almost every grain related parameter of significance in silver halide photography, one area of concern has been susceptibility of high aspect ratio tabular grain emulsions to vary their photographic response as a function of the application of localized pressure on the grains. For example, kinking or otherwise applying pressure locally to a photographic element containing a high aspect ratio tabular grain silver iodobromide emulsion results in a visually detectable elevated optical density in the area of pressure application.

Piggin et al U.S. Pat. Nos. 5,061,609 and 5,061,616 disclose processes of preparing high aspect ratio tabular grain silver iodobromide emulsions in which the iodide is nonuniformly distributed in the form of laminae on the major faces of the grains to improve speed-granularity relationships. To minimize sensitivity variance as a function of applied pressure, either the higher iodide laminae or overlying silver bromide laminae are formed within the boundary of Curve A (preferably Curve B) by precipitation pAg and temperature. pAg is the negative logarithm of silver ion activity. At equilibrium pAg is related to pBr in silver bromide and iodobromide emulsions by the relationship:

$$-\log K_{sp} = pBr + pAg \quad (II)$$

where pBr and pAg are as defined above and $K_{sp}$ is the solubility product constant of silver bromide.

For silver bromide emulsions the upper and lower boundaries of Curve A of Piggin et al correspond to a constant pBr of 2.8 and 4.3, respectively, while the upper and lower boundaries of Curve B correspond to a constant pBr of 3.2 and 4.0, respectively. The presence of minor amounts of iodide ion in silver iodobromide emulsions does not significantly alter pBr, since the equilibrium solubility of silver iodide is approximately two orders of magnitude lower than that of silver bromide.

Piggin et al in each patent teaches the formation of laminae on the major faces of the tabular grains to reduce sensitivity variance as a function of locally applied pressure. The teachings of Piggin et al in each patent lead inescapably to the conclusion that in the process disclosed the tabular grains must be inherently increased in thickness to reduce their variation in photographic response as a function of locally applied pressure.

SUMMARY OF THE INVENTION

It has been discovered quite unexpectedly that it is possible to decrease pressure induced photographic performance variations of high aspect ratio tabular grain emulsions by a process of preparation that decreases the thickness of the tabular grains.

This discovery is contradictory to the prior teachings in the art. Whereas previously it was thought that tabular grain growth at a pBr of greater than 2.2 would tend to thicken tabular grains, it has now been discovered that grain growth under pAg conditions corresponding to pBr values significantly greater than 2.2 in silver bromide and iodobromide emulsions can actually reduce tabular grain thickness when significant concentrations of chloride ion are present during precipitation. The discovery is particularly contrary to the teachings of Piggin et al, cited above, that laminae formation on the major faces of tabular silver bromide and iodobromide grains are responsible for reducing variations in photographic response as a function of locally applied pressure.

In one aspect this invention is directed to a process of preparing a high aspect ratio tabular grain emulsion in which greater than 50 percent of total grain projected area is accounted for by tabular grains containing at least 50 mole percent bromide, based on total silver, and exhibiting an average aspect ratio of greater than 8 wherein (a) grain growth accounting for 5 to 90 percent of total silver incorporated into the tabular grains is conducted within the pAg and temperature boundaries defined by Curve A in FIG. 1 and (b) during step (a) chloride ion in the amount of at least 0.4 mole percent chloride, based on total silver introduced during precipitation, is present during step (a).

DESCRIPTION OF PREFERRED EMBODIMENTS

This invention is directed to an improved process for the preparation of a high aspect ratio tabular grain emulsion containing high bromide tabular grains. As employed herein the term "high bromide" indicates a bromide content of at least 50 mole percent, based on total silver. Preferably, the high bromide tabular grains contain at least 80 mole percent bromide, based on total silver.

In one specifically preferred form the invention is directed to an improvement of a process of preparing a high aspect ratio high bromide tabular grain emulsion in which grain growth accounting for 5 to 90 percent (preferably 10 to 50 percent) of total silver incorporated into the tabular grains is conducted within the temperature and pAg boundaries of Curve A in FIG. 1, hereinafter also referred to as step (a), and preferably within the boundaries of Curve B in FIG. 1. The upper and lower boundaries of Curve A correspond to pBr values of 2.8 and 4.3, respectively, in the precipitation of silver bromide and iodobromide emulsions. The upper and lower boundaries of Curve B correspond to pBr values of 3.2 and 4.0, respectively. The side boundaries of Curves A and B are not critical. The boundaries of Curve A located at 30° C. and 90° C. were chosen because these temperatures represent practically attractive temperature boundaries for emulsion preparation. The boundaries of Curve B located at 40° C. and 80° C. embrace the temperatures most commonly employed in emulsion manufacture. Since the boundaries of Curve B lie entirely within the boundaries of Curve A, all subsequent references to curve boundaries satisfying the requirements of the invention reference only Curve A, but it is to be understood that the Curve B boundaries are in all instances the preferred boundaries.

The mechanism by which grain growth within the boundaries of Curve A reduces variance of photographic response as a function of applied pressure is not fully understood. However, investigations suggest that grain growth within the boundaries of Curve A is conducive to reducing defects, including defects introduced by grain growth prior to adjusting pAg within the boundaries of Curve A, in the face centered cubic crystal structure of the tabular grains. Therefore, to obtain the maximum benefit from grain growth within the boundaries of Curve A, it is therefore preferred that grain growth step (a) be chosen to extend over the final 5 to 90 percent (preferably 10 to 50 percent) of silver introduction during high bromide tabular grain precipitation.

Contrary to the teachings of Piggin et al, cited above, reduction in pressure induced performance variance of the emulsions of this invention is entirely independent of iodide placement in the tabular grains and can, in fact, be realized in emulsions prepared according to the process of the invention that contain no silver iodide.

Also contrary to the teachings of Piggin et al, it has been observed that tabular grain growth within the boundaries of Curve A can be achieved without thickening of the tabular grains. This is achieved by the presence of chloride ion during grain growth step (a). Chloride ion introduction satisfying the requirements of the invention is hereinafter also referred to as step (b).

Not only is it surprising that chloride ion introduction during step (a) is effective to reduce tabular grain thicknesses, it is also surprising that only small quantities of chloride ion are required to achieve this effect. To illustrate this, Wey et al U.S. Pat. No. 4,414,306 discloses that large excesses of chloride ion must be present to incorporate even small amounts of chloride ion in high bromide tabular grains. For example, in Table I (column 10) of Wey et al it is disclosed that incorporation of 1 mole percent chloride ion into a high bromide tabular grain requires that at a precipitation temperature of 55° C. there be a 3:1 molar ratio of chloride ion to bromide ion.

It has been discovered that reductions in tabular grain thickness can be realized when as little as 0.4 mole percent chloride ion, based on total silver, is introduced during precipitation. Maximum reductions in high bromide tabular grain thickness are realized when from 1 to 20 mole percent (optimally 1 to 10 mole percent) chloride ion, based on total silver introduced during precipitation, is employed in step (b). It is, of course, possible to add higher levels of chloride ion for other purposes. For example, if a significant chloride ion concentration at any level of up to 50 mole percent is desired, this can be accommodated merely by increasing the levels of chloride ion introduced during precipitation as taught by Wey et al, cited above.

The mechanism by which chloride ion reduces the thickness of the high bromide tabular grains is not understood, nor is it understood to what extent chloride ion is introduced into the grains or at what locations. During microscopic observations of emulsion preparations it has been noted that the presence of chloride ion sharpens the edges and corners of the tabular grains as they are being formed. This suggests at least initial incorporation of chloride ion into the high bromide tabular grains as they are being formed. However, as one would expect, based on the approximately two orders of magnitude higher solubility of silver chloride as compared to that of silver bromide, the presence of chloride ion renders the grains highly susceptible to physical ripening effects. Thus, the sharpened tabular grain edges and corners observed during grain growth are quickly rounded by spontaneous ripening following precipitation.

To maximize tabular grain thickness reduction by chloride ion addition, it is preferred to complete chloride ion introduction prior to grain growth step (a). This is particularly true where chloride ion addition at levels of 10 mole percent or less is being undertaken solely for this one purpose. The optimum interval for chloride ion introduction during precipitation occurs after tabular grain nucleation has been completed and prior to step (a). Chloride ion introduced into the emulsion as it is being formed is effective whether undertaken gradually (e.g., introduced by a run procedure) or abruptly (e.g., dumped into the emulsion). Chloride ion can be introduced in the form of a soluble salt (e.g., ammonium, alkali or alkaline earth chloride) or in the form of a fine grain emulsion (e.g., a silver chloride Lippmann emulsion).

As is well recognized in the art the nucleation of high bromide tabular grains is preferably accomplished by the formation of silver bromide grain nuclei containing parallel twin planes. Following the teachings of Wilgus et al, Kofron et al and Solberg et al, cited above and here incorporated by reference, iodide ion is preferably excluded during grain nucleation, even when iodide containing tabular grain emulsions are to be formed, since the effect of iodide ion present during nucleation is to thicken the tabular grains. The presence of chloride ion during nucleation does not thicken the tabular grains formed, but it does alter grain nucleation sufficiently that grain nucleation optimizations empirically developed for bromide as the sole halide ion present can be no more than coincidentally optimum when chloride is also present. For this reason it is preferred to employ grain nucleations developed for silver bromide and to defer chloride addition until after the completion of nucleation.

The nucleation step of emulsion precipitation is generally understood to extend over that portion of the precipitation in which the tabular grain nuclei are being formed—that is, a significant fraction of the silver being precipitated is being consumed in the formation of new grains rather than depositing on grains already in existence. While conditions can be controlled to continue grain nucleation over an extended period, in the interest of limiting grain size dispersity it is conventional practice to create a grain population and to cease grain nucleation while consuming a minimal fraction of total silver. It is generally preferred to complete nucleation prior to introduction of 2 percent of total silver, with efficient nucleating steps often consuming less than 1 percent or even less than 0.5 percent of total silver.

Although not required to achieve the advantages of the invention, the incorporation of minor amounts of iodide into the high bromide tabular grains is preferred to obtain the highest achievable speed-granularity relationships (see Kofron et al for an extended explanation). Iodide can be incorporated into the high bromide tabular grains up to its solubility limit in the face centered cubic crystal lattice structure provided by bromide and chloride ions. Although iodide maximum incorporation can vary as a function of chloride ion concentrations and preparation temperatures, it is generally recognized that iodide inclusions of up to approximately 40 mole percent, based on total silver, are possible in a silver bromide crystal lattice structure. However, for photographic purposes substantially lower levels of iodide are preferred, with preferred iodide levels seldom exceeding 20 mole percent. In fact, speed-granularity relationship advantages can be largely realized with iodide concentrations as low as 0.5 mole percent. Higher iodide concentrations are nevertheless common to specific photographic applications to achieve varied effects, such as increased native sensitivity to blue light or to improve interimage effects in multicolor photographic elements. Since iodide ion release is known to retard the rate of emulsion development, it is generally preferred to employ iodide concentrations of less than 10 mole percent and preferably less than 5 mole percent, based on total silver.

Iodide can be distributed either uniformly or non-uniformly within the high bromide tabular grains. When uniform iodide is contemplated, it is preferred to introduce iodide during grain growth accounting for at least 70 percent of total silver introduction. Thus, preferably iodide ion introduction is commenced following grain nucleation. It is also preferred to terminate iodide introduction just prior to completing silver introduction. This reduces development inhibition by iodide ion. Deposition of up to the final 5 percent and optimally 2 percent of silver without further iodide precipitation as taught by Piggin et al U.S. Pat. No. 5,061,609 is specifically contemplated.

Both Solberg et al and Piggin et al disclose the speed-granularity advantages of non-uniform iodide placement within high bromide tabular grains. To maximize speed-granularity performance it is contemplated to introduce iodide ion so that a higher concentration exists within a localized area of the tabular grain. This effect can be realized independently of whether iodide is introduced at a lower level during any remaining portion of the tabular grain precipitation. It is generally preferred to introduce iodide ion within a period of less than 10 minutes to achieve a high localized concentration of iodide ion within the tabular grains. Optimally iodide ion is introduced abruptly, preferably in less than 10 seconds. The higher speed-granularity efficiencies of tabular grain emulsions containing abruptly introduced iodide allow lower level introductions. For example, it is specifically contemplated to introduce iodide in the amount of from 0.5 to 4 mole percent of total silver within less than 10 seconds to produce an emulsion having extremely efficient speed-granularity properties.

Since silver iodide, unlike silver chloride and silver bromide, does not alone form a face centered cubic crystal lattice structure, it is intuitively apparent that abruptly introducing elevated iodide concentrations have the potential of introducing strains and/or disruptions in the crystal lattice of the high bromide tabular grains being grown. Therefore, although abrupt iodide ion addition can be undertaken at any time following the tabular grain nucleation, it is preferred to defer abrupt addition of iodide until at least 50 percent (preferably 70 percent) of total silver has been introduced. This shifts disruptions in the tabular grain crystal structure to a latter stage of grain growth and thereby minimizes their influence on subsequent crystal growth.

However, as pointed out by Piggin et al, abrupt iodide additions can in themselves constitute significant sources of pressure induced variances in photographic performance. For this reason it is preferred that at least a minimal portion of the step (a) grain growth occurs following the abrupt addition of iodide. That is, it is preferred that at least 5 percent (and most preferably at least 10 percent) of total silver is introduced under conditions within the boundaries of Curve A following any abrupt introduction of iodide.

Taking the competing considerations noted above into account, a practically preferred window for abrupt iodide addition to the high bromide tabular grains occurs within the range of from 50 to 90 percent of total silver addition, optimally within the range of from 60 to 80 percent of total silver addition.

Iodide can be introduced during precipitation in any convenient conventional form. For example, iodide can be introduced as a soluble salt (e.g., ammonium, alkali or alkaline earth iodide) or as a Lippmann emulsion.

In addition to the features specifically discussed above the preparation of high aspect ratio high bromide tabular grain emulsions according to the process of the present invention can take any convenient conventional form.

From the description above it is apparent that any conventional high bromide tabular grain nucleation step for producing high aspect ratio tabular grain emulsions in which the tabular grains contain parallel twin planes and have {111} major grain faces can be employed. Techniques for the tabular grain nucleation step are fully described by Wilgus et al, Kofron et al, Solberg et al and Piggin et al, all cited above and here incorporated by reference. Other teachings of useful nucleation steps of particular interest here incorporated by reference include:

Maskasky U.S. Pat. No. 4,713,320, which discloses precipitation in the presence of a low methionine gelatino-peptizer;

Tsaur et al U.S. Pat. No. 5,210,013, which discloses preparation of very low coefficient of variation tabular grain emulsions in the presence of selected polyalkylene oxides;

Antoniades et al U.S. Pat. No. 5,250,403, which discloses techniques for preparing ultrathin (<0.07 μm) tabular grain emulsions as well as emulsions of extremely high (>97%) tabular grain projected areas;

Saitou et al U.S. Pat. No. 4,797,354, which discloses preparations of tabular grain emulsions containing a high proportion of tabular grains with hexagonal major faces;

Daubendiek et al U.S. Pat. No. 4,914,014, which discloses the nucleation of tabular grain emulsions at high pBr levels; and Zola et al published European patent application 0 362 699, which discloses preparations of high aspect ratio tabular grain emulsions with low coefficients of variation in relation to their ECD.

In addition to following the teachings of any one of the above patents for grain nucleation, their teaching can be followed also for performing any portion of the grain growth step that is not conducted within the boundaries of Curve A as well as for selections during step (a) of conventional features not explicitly described.

The high bromide tabular grain emulsions preparedly the practices of the invention in all instances exhibit high (>8) average aspect ratios. Since thickening of the tabular grains is reduced by the process of the present invention, tabular grain emulsions with average tabular grain thicknesses of less than 0.3 μm are readily achieved. Both thin and ultrathin tabular grain emulsions can be prepared by the practice of the invention, where "thin" and "ultrathin" tabular grain emulsions are understood to be those in which greater than 50 percent of total grain projected area is accounted for tabular grains having thicknesses of less than 0.2 μm and 0.07 μm, respectively. Since the process can produce thin and ultrathin tabular grain emulsions, it is also apparent from relationship (I) that the average aspect ratios of the tabular grain emulsions can range up to the highest levels heretofore observed in preparing tabular grain emulsions for photographic use. With average grain ECD values for photographic applications being limited to less than 10 μm as an extreme and for the overwhelming majority of photographic applications to less than 5 μm, average aspect ratios of greater than 100 and up to 200 can be realized. The process of the present invention produces emulsions with tabular grain projected areas of greater than 50 percent. The preferred processes of the present invention produce tabular grain projected areas of at least 70 percent of total grain projected area and tabular grain projected areas can range up to 97 percent or more of total grain projected area. By employing the process of the present invention in combination with compatible processes of precipitation cited above (e.g., the process of Tsaur et al or Saitou et al) it is possible to realize the low thickness and ECD coefficients of variation that these cited processes produce.

In addition to their grains the emulsions preparedly the process of this invention contain an aqueous dispersing medium. The dispersing medium can be maintained within conventional pH ranges for emulsion precipitation, typically in a pH range of from 2 to 7. The dispersing medium contains a peptizer to maintain dispersion of the grains. Any conventional hydrophilic colloid peptizer can be employed. A summary of such peptizers is included in *Research Disclosure*, Vol. 308, December 1989, Item 308119, Section IX, sub-section A. *Research Disclosure* is published by Kenneth Mason Publications, Ltd., Dudley House, 12 North St., Emsworth, Hampshire P010 7DQ, England. Preferred peptizers are gelatino-peptizers. Mignot U.S. Pat. No. 4,334,012, here incorporated by reference, discloses management of grain nucleation and growth to provide an optimum dispersing medium for precipitation.

The processes of precipitation of this invention are entirely compatible with the incorporation of metal and metal complex dopants in the grains, illustrated by *Research Disclosure*, Item 308119, Section I, sub-section D, here incorporated by reference. Other compatible conventional emulsion preparation variations are disclosed in sub-sections E, F, G and H. The subsequent sub-section I and subsequent sections of *Research Disclosure*, Item 308119, illustrate how the emulsions prepared by the process of the invention can be further acted upon to serve specific photographic applications.

EXAMPLES

The invention can be better appreciated by reference to the following specific examples, significant parameters of which are summarized in Tables I and II. The speeds (measured at a density of 0.15 above fog) of the emulsions described below were evaluated as an emulsion layer on a photographic film support, the emulsion layer exhibiting a coating density of 16.1 mg/dm$^2$ silver. The emulsion layer was exposed through a graduated density step tablet for 0.5 second by a 365 nm line radiation source and then processed for 8 minutes in a hydroquinone-Elon TM (N-methyl-p-aminophenol hemisulfate) developer commercially available as Kodak D-76 developer.

Pressure induced variances of photographic speed were measured by comparing the speed difference between coatings with and without the application of 0.17 kPa (25 psi) roller pressure before exposure. To avoid any possibility of attributing differences in response to pressure to differences in sensitization, the emulsions were coated and compared without undertaking chemical or spectral sensitization.

Example 1C (A Comparative Example)

In this example a tabular grain emulsion was prepared in which all of the growth silver was added at a conventional pAg (pAg=9, 60° C.) for high bromide high aspect ratio tabular grain emulsion preparation. The pAg is shown as point C in FIG. 1.

The purpose of this example is to provide a point of reference illustrating tabular grain thickness when pAg is maintained at a conventional level outside the boundaries of Curve A in FIG. 1 and no chloride is present during the preparation of an iodobromide high aspect ratio tabular grain emulsion.

A total of 3.3 moles of silver iodobromide were precipitated in the following manner:

A reaction vessel equipped with a stirrer was charged with 3.2 L of distilled water, 35 mL of 2N $H_2SO_4$, 20 mL of 1N NaBr, 7.5 gm of hydrogen peroxide treated, non-deionized, lime-processed bone gelatin, and an antifoamant at 35° C. The pH was 1.9 and the pAg was 9.5. Nucleation was accomplished by simultaneous addition of 10 mL each of 2N solutions of AgNO3 and NaBr at a rate of 0.012 mol/min. Immediately thereafter, the temperature was raised to 60° C. over a 15 min period. Then 50 gm of gel (same as above) in 250 mL of water were added, the pH was adjusted to 6.0 with dilute NaOH, and enough 1N NaBr was added to adjust the pAg to 9.0. The first growth step was begun by the simultaneous addition of 1.6N $AgNO_3$ and AgI at the constant rate of 0.038 mol Ag/min for 10 min during which time 1.75N NaBr was also added at a rate to maintain the measured pAg. The second growth step was a linear ramp from 0.038 to 0.092 mol Ag/min over 40 min and used exactly the same growth salt solutions as the first growth step with the pAg held constant at 9. When growth was complete, the emulsion was cooled to 40° C. and isolated by adding 40 mL of an aqueous solution of 25% by weight phthalated gelatin. The emulsion was then washed twice by the coagulation method described in Yutzy et al U.S. Pat. No. 2,614,929, and 250 mL of an aqueous solution of 30% by weight bone gelatin were added. The pH and pAg of the emulsion were adjusted to 6.0 and 9.2, respectively at 40° C.

The emulsion was examined by scanning electron microscopy (SEM) and shown to consist almost entirely of hexagonal and triangular tabular grains. The average equivalent circular diameter (ECD) of the tabular grains was 1.30 μm and the average tabular grain thickness was 0.047.

When coatings of this emulsion were subjected to roller pressure before exposure and compared to the same coatings with no applied pressure, the coatings that were not pressure treated were 0.21 log E (E represents exposure in lux-seconds) lower in speed than those that were. This indicated a high level of pressure sensitivity. Example 2C (A Comparative Example)

This example demonstrates the effect of shifting precipitation from point C in FIG. 1 to point D for the final 14 percent of silver precipitation during grain growth.

This emulsion was precipitated exactly like that of Example 1C, but with the following exception: During the second growth step, when the amount of silver precipitated was equal to 86% of the total to be precipitated, the addition of growth salts was stopped, and the pAg was adjusted to 7.5 (point D in FIG. 1) by the addition of 1.9N $AgNO_3$. Thereafter, growth was continued as before, but at the 7.5 pAg value.

The emulsion was isolated as in Example 1C. When examined by SEM the emulsion grains were observed to consist almost entirely of tabular grains with rounded edges and corners. Average grain ECD was 1.08 μm, and average grain thickness was 0.068 μm. By referring to Table I it is apparent that grains exhibited a thickness increase resulting from the low pAg growth step.

When coatings of this emulsion were subjected to roller pressure before exposure and compared to the same coatings with no applied pressure, the coatings that were not pressure treated were 0.135 log E lower in speed than those that were. This indicated a lower level of pressure sensitivity than was observed for the emulsion of Example 1C.

Examples 3E–6E

The emulsion precipitation of Example 2 was repeated, except that immediately prior to the start of the first growth step, an amount of 1N NaCl equal to 9.14 mole % (Example 3E) , 4.59 mole % (Example 4E) , 1.57 mole % (Example 5E), or 0.77 mole % (Example 6E) of the total silver to be precipitated was dumped into the reaction vessel.

The average ECD's of the grains of Examples 3E, 4E, 5E, and 6E were 1.31, 1.21, 1.29, and 1.30 μm, respectively, and their average thicknesses were 0.051, 0.047, 0.052, and 0.056 μm, respectively. Referring to Table I it is apparent that the introduction of chloride offset the increase in tabular grain thickness induced by shifting the latter stage of grain growth from a pAg of 9.0 to 7.5.

When coatings of the emulsion of Example 4E were subjected to roller pressure before exposure and compared to the same coatings with no applied pressure, the coatings that were not pressure treated were 0.075 logE lower in speed than were the coatings that had pressure applied before exposure. This demonstrated that the presence of chloride not only prevented tabular grain thickening due to the low pAg of the latter stage of grain growth, but also further reduced the pressure induced sensitization of the emulsion.

Examples 7E and 8E

The emulsion preparations of Example 2C were repeated, except that after the growth pAg shift to pAg=7.5, enough NaCl was added to the remaining NaBr growth salt solution to obtain 1.32 mole % chloride (Example 7E) or 0.44 mole % chloride (Example 8E).

Emulsions consisting almost entirely of tabular grains were obtained. The average ECD's of the grains of Examples 7E and 8E were both 1.24 μm, but their average thicknesses were 0.058 and 0.060 μm, respectively. This demonstrated that the addition of small amounts of chloride after the pAg shift were effective in reducing thickness growth.

By comparing emulsions 5E and 7E it is apparent that chloride addition following grain nucleation and before grain growth is preferred to delaying chloride ion introduction until pAg is shifted to satisfy the boundaries of Curve A during the latter stage of grain growth.

By comparing emulsions 7E and 8E it is apparent that lower grain thicknesses can be realized by introducing at least 1.0 mole % chloride, based on total silver introduced.

Example 9E

The emulsion precipitation of Example 4E was repeated, except that an amount of 1N NaCl equal to 4.58 mole % of the total silver to be precipitated was dumped into the reaction vessel immediately prior to the pAg shift rather than prior to the start of growth.

An emulsion consisting almost entirely of tabular grains was obtained. The average ECD of the grains was 1.24 μm and their average thickness was 0.054 μm.

This example demonstrates that chloride added just prior to the pAg shift prevented most of the thickness growth that was observed in Example 2C, but was not as effective as chloride added prior to the start of the growth step as in Example 4E.

Example 10E

The emulsion precipitation of Example 4E was repeated, except that the last 14% of silver was added at pAg=7.15 (point E in FIG. 1) instead of at pAg=7.5 (point D).

An emulsion consisting almost entirely of tabular grains was obtained. The average ECD of the grains was 1.33 μm, and their average thickness was 0.054 μm.

The results were quite similar to those of Example 9E, indicating that chloride is effective to reduce thickness growth at both pAg 7.5 and 7.15, both within the boundaries of Curve B in FIG. 1. Example 11C (A Comparative Example)

The emulsion precipitation of Example 2C was repeated, except that no iodide was introduced into the emulsion.

The silver bromide emulsion was examined by SEM and observed to consist almost entirely of tabular grains. The edges and corners of the tabular grains were rounded. The average ECD of the grains was 1.04 μm, and their thickness was 0.063 μm.

Example 12C (A Comparative Example)

The emulsion precipitation of Example 11C was repeated, except that the first 70% (rather than 86%) of silver addition occurred at high pAg (pAg=9, 60° C.) while the last 30% of silver was added at a pAg=7.5.

The silver bromide emulsion was examined by SEM and observed to consist almost entirely of tabular grains. The edges and corners of the tabular grains were rounded. The average ECD of the grains was 0.896 μm, and their thickness was 0.086 μm.

EXAMPLE 13E

The emulsion precipitation of Example 12C was repeated, except that immediately prior to the start of the first growth step, a quantity of 1N NaCl equal to 4.7 mole % of the total silver to be precipitated was dumped into the reaction vessel. The silver bromide emulsion was examined by SEM and observed to consist almost entirely of tabular grains. The edges and corners of the tabular grains were noticeably less rounded than those of Example 12C. The average ECD of the grains was 1.07 μm, and their thickness was 0.064 μm. The reduced thickness of the tabular grains as compared to those of Example 12C was attributed to the addition of chloride.

Examples 14E–16E

The emulsion precipitation of Example 11C was repeated, except that immediately prior to the start of the first growth step, a quantity of 1N NaCl equal to 9.37 mole % (Example 14E), 4.70 mole % (Example 15E), or 3.16 mole % (Example 16E) of the total silver to be precipitated was dumped into the reaction vessel.

Tabular grain emulsions consisting almost entirely of tabular grains were obtained. The emulsions were examined by SEM, revealing tabular grains with hexagonal or triangular major faces. The edges and corners of the tabular grains were noticeably less rounded than in Example 11C. The measured average grain ECD's were 1.06, 1.20, and 1.10 μm, respectively. The average thicknesses of the same grains were 0.058, 0.055, and 0.057 μm, respectively.

By referring to the summary of properties in Table I it is apparent that the thicknesses of the tabular grains in these example emulsions were significantly lower than those of comparative Example 11C.

Example 17E

The emulsion precipitation of Example 14E was repeated, except that the one half of the 9.37 mole % of NaCl, based on total silver introduced, was added immediately prior to the start of the first growth step and the other half was added immediately prior to the shift to pAg 7.5.

The emulsion was examined by SEM and observed to consist almost entirely of hexagonal and triangular tabular grains. The average grain ECD was 1.12 μm, and average grain thickness was 0.056 μm. By comparing the emulsions of Examples 11C and 17E in Table I it is apparent that chloride addition resulted in obtaining lower tabular grain thicknesses.

TABLE I

| Ex | Growth pAg (%Ag) | I M % | CI M% | CI Management | ECD | t | t |
|---|---|---|---|---|---|---|---|
| 1C | 9.0(100%) | 3 | 0 | none added | 1.30 | .047 | 27.7 |
| 2C | 9.0(86%)/7.5(14%) | 3 | 0 | none added | 1.08 | .068 | 15.9 |
| 3E | 9.0(86%)/7.5(14%) | 3 | 9.14 | pre growth | 1.31 | .051 | 25.8 |
| 4E | 9.0(86%)/7.5(14%) | 3 | 4.59 | pre growth | 1.21 | .047 | 25.7 |
| 5E | 9.0(86%)/7.5(14%) | 3 | 1.57 | pre growth | 1.29 | .052 | 24.8 |
| 6E | 9.0(86%)/7.5(14%) | 3 | 0.77 | pre growth | 1.30 | 0.56 | 23.2 |
| 7E | 9.0(86%)/7.5(14%) | 3 | 1.32 | after pAg shift | 1.24 | .058 | 21.4 |
| 8E | 9.0(86%)/7.5(14%) | 3 | 0.44 | after pAg shift | 1.24 | .060 | 20.1 |
| 9E | 9.0(86%)/7.5(14%) | 3 | 4.58 | pre pAg shift | 1.24 | .054 | 23.2 |
| 10E | 9.0(86%)7.15(14%) | 3 | 4.55 | pre pAg shift | 1.33 | .054 | 24.6 |

TABLE I-continued

| Ex | Growth pAg (%Ag) | I M % | CI M% | CI Management | ECD | t | t |
|---|---|---|---|---|---|---|---|
| 11C | 9.0(86%)/7.5(14%) | 0 | 0 | none added | 1.04 | .063 | 16.5 |
| 12C | 9.0(70%)/7.5(30%) | 0 | 0 | none added | .896 | .086 | 10.4 |
| 13E | 9.0(70%)/7.5(30%) | 0 | 4.70 | pre growth | 1.07 | .064 | 16.7 |
| 14E | 9.0(86%)/7.5(14%) | 0 | 9.37 | pre growth | 1.06 | .058 | 18.3 |
| 15E | 9.0(86%)/7.5(14%) | 0 | 4.70 | pre growth | 1.20 | .055 | 21.8 |
| 16E | 9.0(86%)/7.5(14%) | 0 | 3.16 | pre growth | 1.10 | .057 | 19.3 |
| 17E | 9.0(86%)/7.5(14%) | 0 | 9.37 | pre growth & pre pAg shift | 1.12 | .056 | 20.0 |

Example 18

Further observations were conducted to determine the deviation of tabular grain thicknesses. As reported by Buhr et al *Research Disclosure*, Vol. 253, May 1985, Item 25330, small differences in tabular grain thicknesses can have a significant impact on tabular grain reflectance as a function of wavelength in the visible portion of the spectrum.

The standard deviations of representative emulsions from the Examples above are compared in Table II.

TABLE II

| Ex | CI M % | ECD | t | t, std dev | AR |
|---|---|---|---|---|---|
| 2C | 0 | 1.08 | .068 | .0068 | 15.9 |
| 4E | 4.59 | 1.21 | .047 | .0043 | 25.7 |
| 11C | 0 | 1.04 | .063 | .0079 | 16.5 |
| 14E | 9.37 | 1.06 | .058 | .0068 | 18.3 |
| 17E | 9.37 | 1.12 | .056 | .0064 | 20.0 |

From Table II it is apparent that chloride addition not only reduces tabular grain thicknesses, but additionally reduces the variation of tabular grain thicknesses from grain to grain.

The invention has been described in detail with particular reference to preferred embodiments thereof, but it will be understood that variations and modifications can be effected within the spirit and scope of the invention.

What is claimed is:

1. A process of preparing a high aspect ratio tabular grain emulsion in which greater than 50 percent of total grain projected area is accounted for by tabular grains containing at least 50 mole percent bromide, based on total silver, and exhibiting an average aspect ratio of greater than 8 wherein (a) grain growth accounting for 5 to 90 percent of total silver incorporated into the tabular grains is conducted within the pAg and temperature boundaries defined by Curve A in FIG. 1 and (b) chloride ion in the amount of at least 0.4 mole percent chloride, based on total silver introduced during precipitation, is present during step (a).

2. A process of preparing a high aspect ratio tabular grain emulsion according to claim 1 wherein from 10 to 50 percent of total silver is introduced during step (a).

3. A process of preparing a high aspect ratio tabular grain emulsion according to claim 1 wherein step (a) is conducted with the pAg and temperature boundaries defined by Curve B in FIG. 1.

4. A process of preparing a high aspect ratio tabular grain emulsion according to claim 1 wherein the chloride ion amounts to at least 1 mole percent, based on total silver introduced during precipitation.

5. A process of preparing a high aspect ratio tabular grain emulsion according to claim 4 wherein the chloride ion amounts to from 1 to 20 mole percent, based on total silver introduced during precipitation.

6. A process of preparing a high aspect ratio tabular grain emulsion according to claim 1 wherein the chloride ion is introduced following nucleation of the tabular grains.

7. A process of preparing a high aspect ratio tabular grain emulsion according to claim 1 wherein iodide ion is incorporated into the tabular grains.

8. A process of preparing a high aspect ratio tabular grain emulsion according to claim 7 wherein iodide is introduced during grain growth over a period during which at least 70 percent of total silver incorporated in the tubular grains is introduced.

9. A process of preparing a high aspect ratio tabular grain emulsion according to claim 7 wherein iodide ion is introduced following addition of at least 50 percent of total silver.

10. A process of preparing a high aspect ratio tabular grain emulsion according to claim 9 wherein iodide ion is introduced in less than 1 minute.

11. A process of preparing a high aspect ratio tabular grain emulsion according to claim 10 wherein iodide ion is introduced in less than 10 seconds.

12. A process of preparing a high aspect ratio tabular grain emulsion according to claim 1 wherein step (a) is performed during grain growth accounting for the final 5 to 90 percent of total silver incorporated into the tabular grains.

13. A process of preparing a high aspect ratio tabular grain silver chlorobromide emulsion in which at least 70 percent of total grain projected area is accounted for by tabular grains exhibiting an average aspect ratio of greater than 8 wherein (a) grain growth accounting for the final 10 to 50 percent of total silver incorporated into the tabular grains is conducted within the pAg and temperature boundaries of Curve B in FIG. 1 and (b) during step (a) and following tabular grain nucleation, precipitation is conducted in the presence of chloride ion in the amount of from 1 to 10 mole percent, based on total silver introduced during precipitation.

14. A process of preparing a high aspect ratio tabular grain silver chloroiodobromide or iodochlorobromide emulsion in which at least 70 percent of total grain projected area is accounted for by tabular grains exhibiting an average aspect ratio of greater than 8 wherein (a) grain growth accounting for the final 10 to 50 percent of total silver incorporated into the tabular grains is conducted within the pAg and temperature boundaries defined by Curve B in FIG. 1, (b) during step (a) and following tabular grain nucleation, precipitation is conducted in the presence of chloride ion in the amount of from 1 to 10 mole percent, based on total silver introduced during precipitation, and (c) following grain nucleation iodide ion in the amount of 0.5 to 20 mole percent of total silver is introduced.

15. A process of preparing a high aspect ratio tabular grain chloroiodobromide or iodochlorobromide emulsion according to claim 14 wherein following the addition of at least 50 percent of total silver, the iodide ion, in the amount of from 0.5 to less than 5 mole percent of total silver added during precipitation, is introduced in less than 10 seconds.

16. A process of preparing a high aspect ratio tabular grain emulsion in which greater than 50 percent of total grain projected area is accounted for by tabular grains containing at least 50 mole percent bromide, based on total silver, exhibiting an average aspect ratio of greater than 8 wherein (a) grain growth accounting for 50 to 90 percent of total silver incorporated into the tabular grains is conducted within the pAg and temperature boundaries defined by Curve A in FIG. 1 and (b) chloride ion in the amount of at least 0.4 mole percent chloride, based on total silver introduced during precipitation, is present during step (a), step (b) chloride ion introduction being completed prior to step (a).

* * * * *